US005791393A

United States Patent [19]

Judkins

[11] Patent Number: 5,791,393

[45] Date of Patent: Aug. 11, 1998

[54] SHADE OPERATOR

[76] Inventor: Ren Judkins, 46 Newgate Rd., Pittsburgh, Pa. 15202

[21] Appl. No.: 831,464

[22] Filed: Mar. 31, 1997

[51] Int. Cl.[6] ..... E06B 9/20

[52] U.S. Cl. ..... 160/321; 160/308; 160/84.05

[58] Field of Search ..... 160/321, 291, 160/296, 298, 299, 300, 301, 302, 303, 305, 307, 308, 319, 320, 84.05; 192/41 S, 8 C

[56] References Cited

U.S. PATENT DOCUMENTS

| | | | |
|---|---|---|---|
| 203,414 | 5/1878 | Buckley et al. . | |
| 2,140,049 | 12/1938 | Grauel | 156/10 |
| 3,292,685 | 12/1966 | Clark | 160/26 |
| 4,372,432 | 2/1983 | Waine et al. | 192/8 |
| 4,427,100 | 1/1984 | Rude et al. | 192/43 |
| 4,433,765 | 2/1984 | Rude et al. | 192/41 S |
| 4,476,910 | 10/1984 | Saito | 160/291 |
| 4,651,854 | 3/1987 | Harada | 192/8 |
| 4,779,662 | 10/1988 | Will | 160/321 |
| 4,865,109 | 9/1989 | Sherman | 160/321 |
| 4,869,308 | 9/1989 | Chang | 160/176.1 |
| 4,869,357 | 9/1989 | Batchelder | 192/41 R |
| 5,167,269 | 12/1992 | Abo | 160/305 |
| 5,314,053 | 5/1994 | Nishimura | 192/41 S |
| 5,361,822 | 11/1994 | Nijs | 160/321 |
| 5,375,643 | 12/1994 | Rude | 160/321 |
| 5,482,105 | 1/1996 | Rude | 160/307 |
| 5,507,374 | 4/1996 | Rude | 192/8 C |
| 5,542,464 | 8/1996 | Shiina | 160/296 |
| 5,566,741 | 10/1996 | Ogawara et al. | 160/308 X |

*Primary Examiner*—David M. Purol
*Attorney, Agent, or Firm*—Buchanan Ingersoll, P.C.

[57] ABSTRACT

An operator for a window covering has a stationary member and a hub which is moveable relative to the stationary member when not restrained. Preferably these members are a tube or solid cylinder within a tube. A spring having a selected diameter is fitted between these two generally cylindrical members. A first tang at one end of the spring is attached to the stationary member and a second tang at an opposite end of the spring is attached to a movable member so that one tang can be moved relative to the other tang to increase or decrease the diameter of the spring. The spring is sized and positioned so that the spring will press against the inside surface of the hub when in a relaxed condition. When the tangs of the spring are moved relative to one another to reduce the diameter of the spring, the spring does not restrain movement of the moveable member. In a present preferred embodiment there is a roller attached to the hub at one end. Alternatively, a spool about which lift cords are wound is attached to the hub. A counteracting spring may be attached to the roller or spool.

29 Claims, 10 Drawing Sheets

FIG. 5
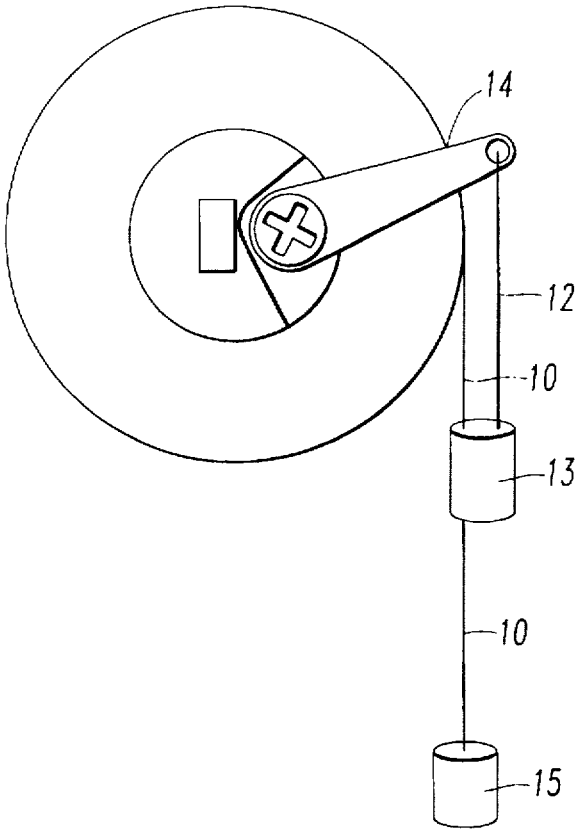
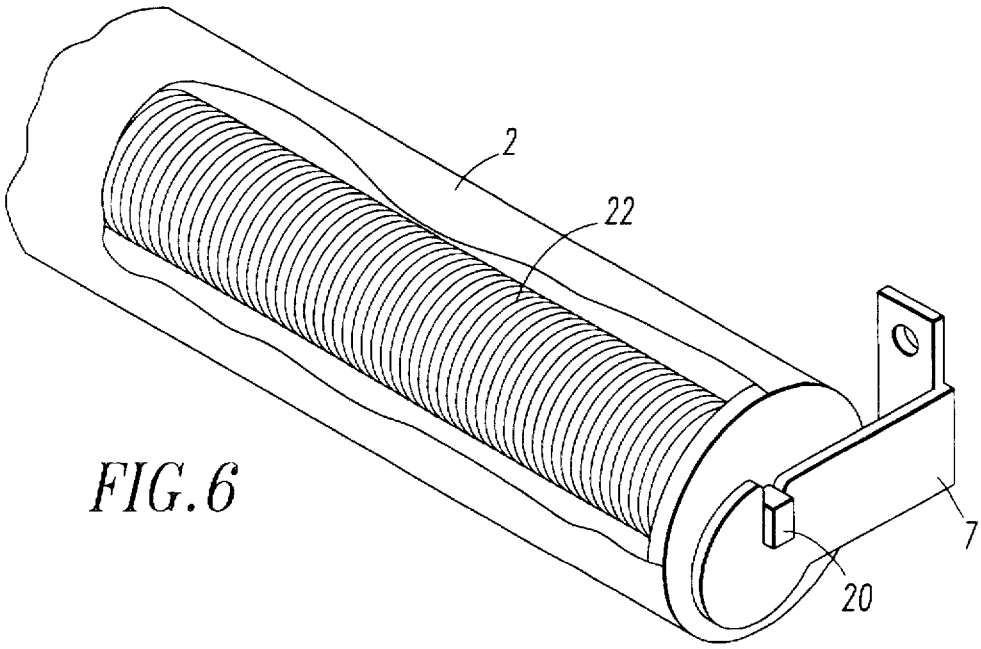
FIG. 6

SHADE OPERATOR

FIELD OF THE INVENTION

The present invention relates to a device for operating and positioning a window covering, particularly a covering that is raised and lowered like a roller shade, a pleated shade, or a venetian blind.

DESCRIPTION OF THE PRIOR ART

In a roller shade window covering material is rolled and unrolled around a tubular core hung on brackets. Conventionally, a spring is provided within the core to raise and counterbalance the lowering of the shade.

The prior art most commonly used for controlling the vertical position of a roller window shade is the ratchet and pawl mechanism. Examples of this mechanism are shown in U.S. Pat. Nos. 203,414 and 2,140,049. The ratchet and pawl mechanism has been in use for many years, but it is notoriously unpopular among users. Criticisms include the necessity of handling the shade material in order to operate the shade, and unreliable operation. Ratchet and pawl mechanisms are often difficult to engage and can only be set at heights corresponding to the tooth spacing of the ratchet. Many times the ratchet and pawl mechanism wears out before other components of the shade.

Another prior art device for controlling window shades is the friction brake. Examples of such brakes are disclosed in U.S. Pat. Nos. 5,184,660 and 5,482,105. These devices have a coiled spring between a central core and a sleeve. These devices apply a fixed torque to resist rotation of the shade roller no matter which direction the roller is turned. These devices suffer from the disadvantage that a substantial force is needed to raise the shade.

The prior art also contains examples of clutch mechanisms that are adapted for the operation of roller shades. Among these are U.S. Pat. Nos. 4,372,432 and 5,361,822. Prior art clutch mechanisms overcome some of the disadvantages of ratchet and pawl devices, but they have some disadvantages of their own. The clutch based devices are operated by a cord loop that hangs from one end of the shade roller. The cord loop eliminates the need for handling of the shade material or a protective shield attached thereto, and the clutch mechanism allows the height of the shade to be precisely set. It also permits the shade to be operated from one end rather than from the center which can be difficult to reach if the window is behind a piece of furniture. Moreover, because of concerns for child safety the industry has been attempting to eliminate looped cords from window coverings. Also, clutch devices tend to be somewhat more expensive than the ratchet and pawl devices, and they require some amount of lost motion to insure proper operation. This lost motion is apparent when beginning to raise the shade. When the cord is first pulled, some motion is required before the shade begins to move. Also, the lost motion can contribute to an oscillating, or surging motion while the shade is lowered.

Clutches and friction brakes have also been used in pleated shades and venetian blinds where the lift cords are wound around a take-up roll located within the headrail. The take-up roll is driven by a loop cord or motor. The loop cord is the subject of child safety concerns and the motorized system is significantly more expensive.

Consequently, there is a need for a reliable shade operator that allows an operator to easily raise and lower shades to any desired position. Preferably, the operator should have a single cord.

SUMMARY OF THE INVENTION

I provide an operator for a window covering of the type having a roller about which either a window covering material or lift cords are wound. There is a stationary member and a hub which is moveable relative to the stationary member when not restrained. Preferably these members are a tube or solid cylinder within a tube. A spring having a selected diameter is fitted between these two generally cylindrical members. A first tang at one end of the spring is attached to the stationary member and the second tang at an opposite end of the spring is attached to a movable member so that one tang can be moved relative to the other tang to increase or decrease the diameter of the spring. I prefer to provide a lever on the moveable member. The spring is sized and positioned so that the spring will press against the inside surface of the hub when in a relaxed condition. When the tangs of the spring are moved relative to one another to reduce the diameter of the spring, the spring does not restrain movement of the moveable member. In a present preferred embodiment there is a roller attached to the hub at one end. The spring and stationary member fit within a cavity in the hub Alternatively, a spool about which lift cords are wound is attached to the hub. A counteracting spring may be attached to the roller or spool.

BRIEF DESCRIPTION OF THE DRAWINGS

FIG. 5 is an end view of the first present preferred shade operator.

FIG. 6 is an end view partially cut away of a roller shade showing a counterbalance spring within the shade.

DESCRIPTION OF THE PREFERRED EMBODIMENTS

Figure 1:
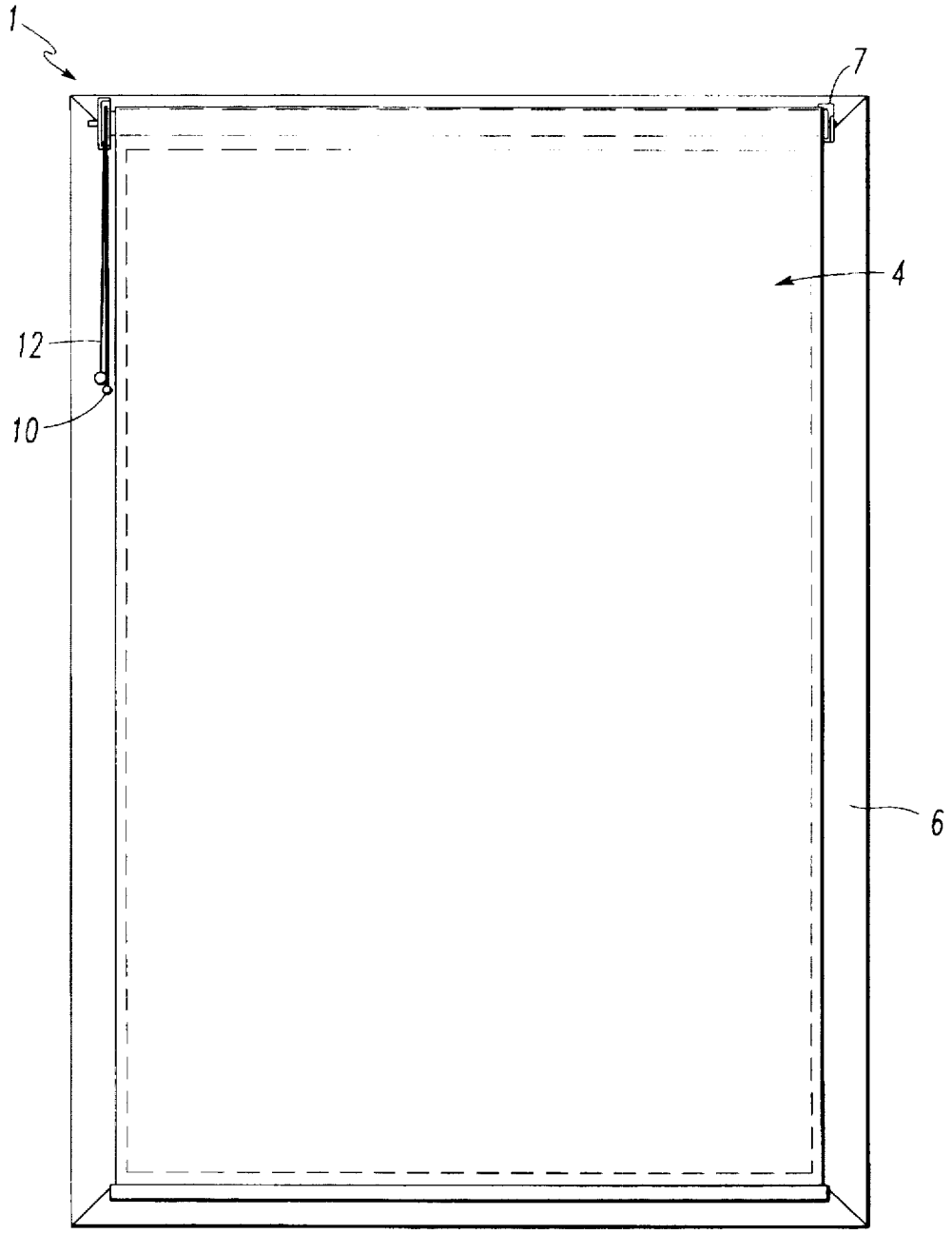
FIG. 1 is a front view of a roller shade containing a first present preferred shade operator in a fully lowered position.
Figure 2:
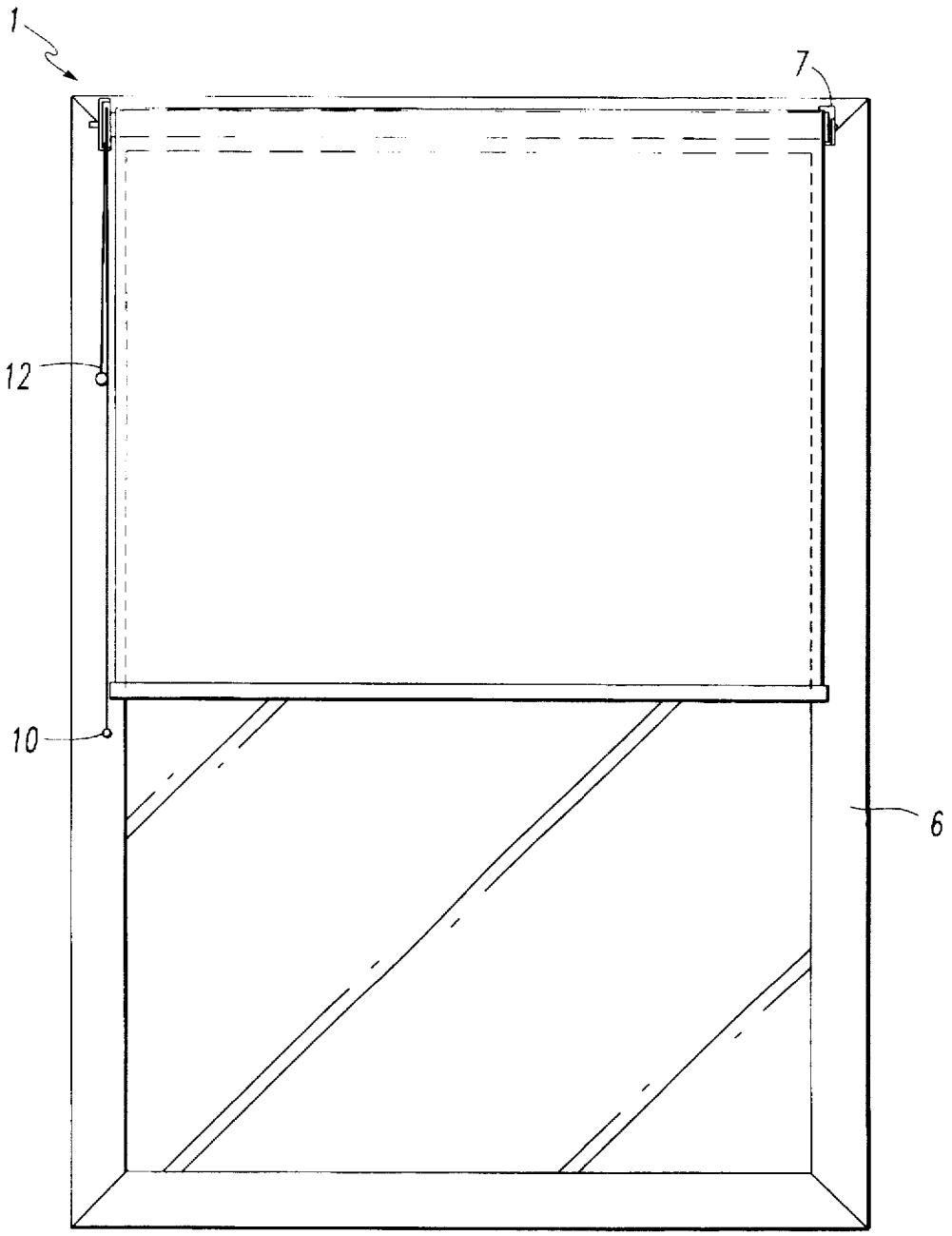
FIG. 2 is a front view similar to FIG. 1 showing the roller shade in a partially lowered position.
Figure 3:
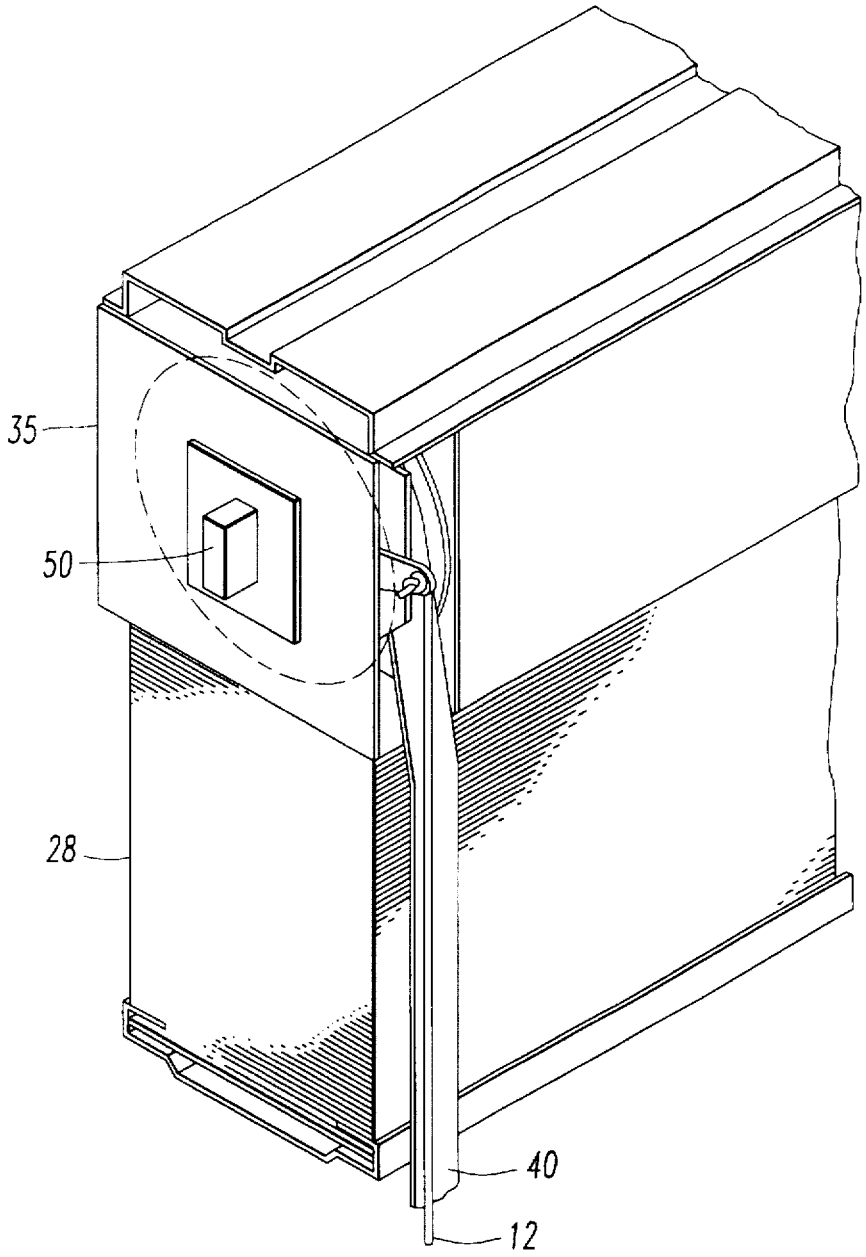
FIG. 3 is a perspective view of an end portion of a pleated shade in a fully raised position which shade contains the first present preferred shade operator.
Figure 4:
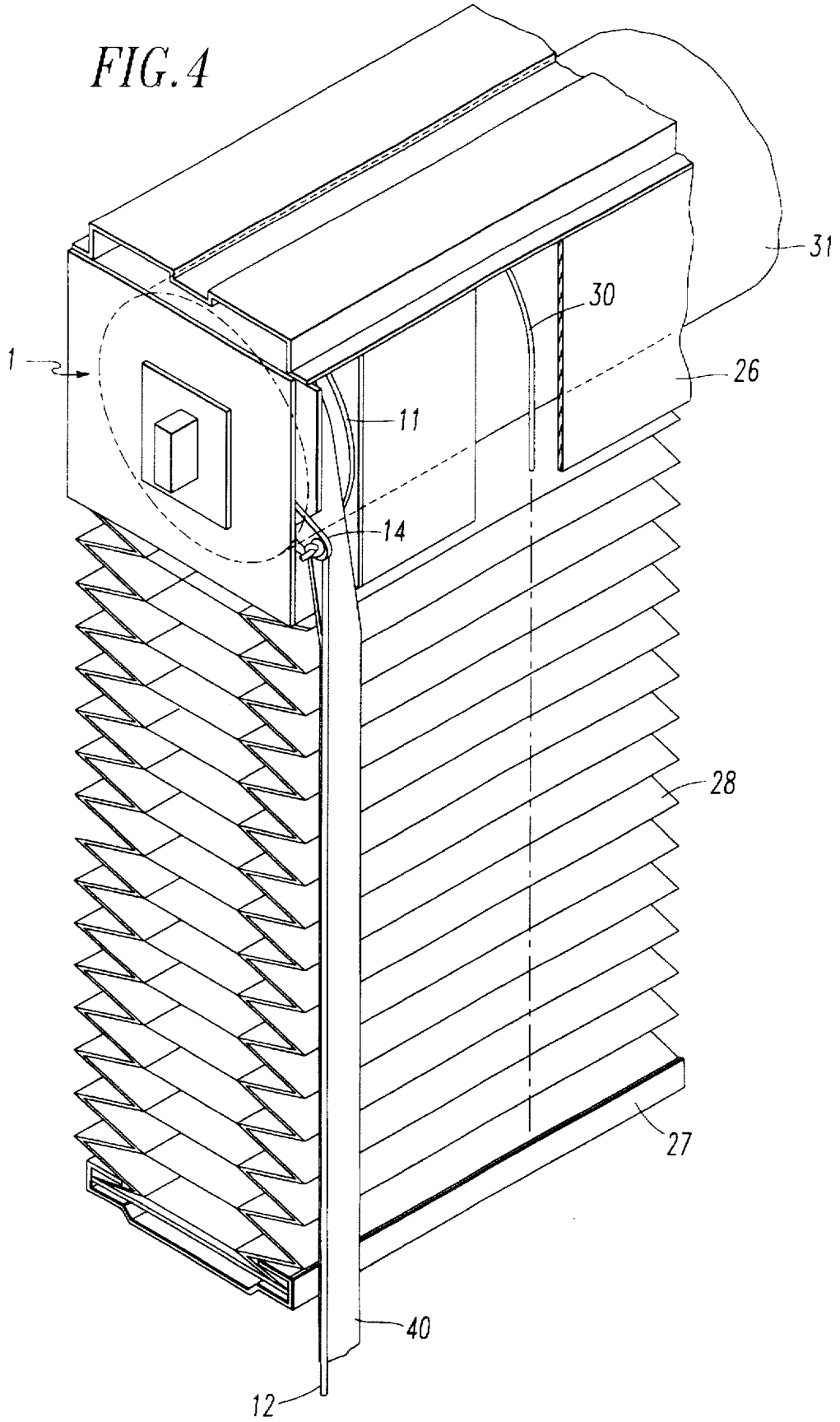
FIG. 4 is a perspective view of the end portion of the pleated shade of FIG. 3 in a fully lowered position.

I provide a shade operator that may be used in conjunction with a roller shade 4 such as shown in FIGS. 1 and 2 or a pleated or cellular shade 28 such as shown in FIGS. 3 and 4. When used in a roller shade, the shade the shade operator 1 is provided at one end of the roller shade. This shade is mounted on window frame 6 by bracket 7. As can be seen most clearly in FIG. 6 there is a roller axle 20 which fits within a slot in the bracket 7. This connection keeps the roller axle 20 stationary while the roller 2 may rotate around stationary roller axle 20. An optional counteracting spring 22 is provided within the roller at the end opposite my shade operator. One end of the counteracting spring is attached to roller 2 while the opposite end is attached to a stationary axle 20. The spring is in a relaxed position when the shade is somewhere in between the fully raised and fully lowered position. This may be higher or lower than shown in FIG. 2. One way to accomplish this is to disengage the axle pin 20 at the desired position and re-engage pin 20 on the mounting bracket after the spring is unwound. The spring 22 winds when the shade is moved up or down from the neutral position. The spring is not intended to lift the shade, but simply to slow the descent speed and partially counterbalance the load. When the shade is moved up from the neutral position, the spring 22 winds and encourages the shade to descend. This is helpful when the shade is completely raised and the edge of the shade is rubbing against the bracket or spool. In this case, the weight of the shade is insufficient to overcome the friction in the system. The tension in spring 22 can overcome the friction and ensure that the shade descends.

In a present preferred embodiment of my shade operator a spool tape or cord 10 is wound around the spool 11. As the shade is lowered the tape 10 is rolled onto the spool. Conversely, when the shade is raised the tape 10 is unrolled from the spool. A release cord 12 is attached to linkage 14. Pulling the release cord causes the linkage 14 to move downward allowing the roll 2 to turn freely.

In the pleated or cellular shade shown in FIGS. 3 and 4, tang 50 extends from the operator through end plate 35 to the headrail. The headrail is mounted to the window frame in a conventional manner. The lift cords 30 of the pleated or cellular shade are wound about a take-up spool 31 within headrail 26 as shown in FIG. 4. For this embodiment I provide a tape cord 40 which is wider than release cord 12. The release cord 12 terminates at the release handle 13 while the spool tape 10 passes through the handle 13 and terminates at the tassel 15.

Figure 7:
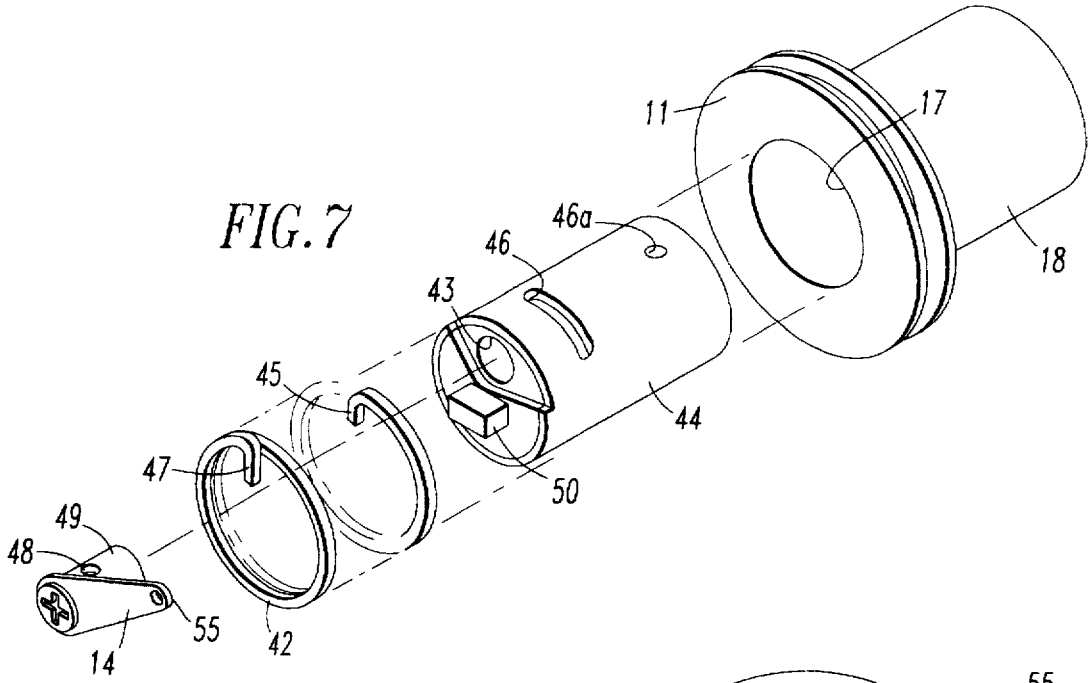
FIG. 7 is an exploded view of the first present preferred shade operator.
Figure 8:
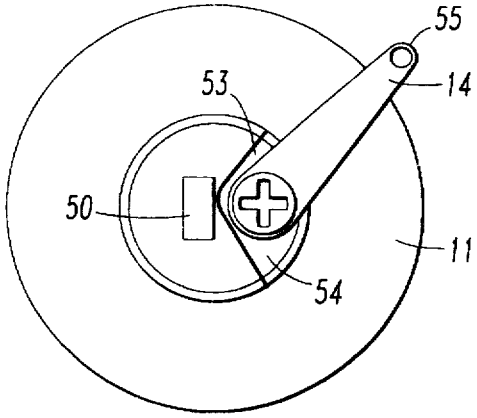
FIG. 8 is an end view of the first present preferred shade operator with the linkage in a gripping position.
Figure 9:
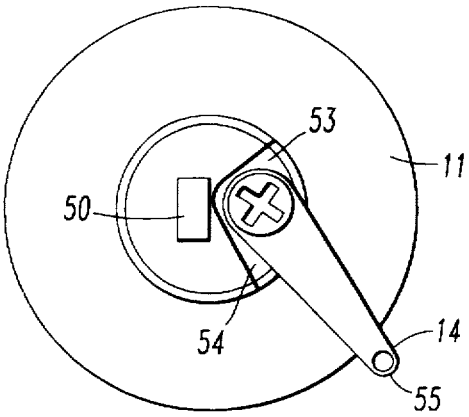
FIG. 9 is an end view similar to FIG. 8 showing the linkage in a release position.

Referring now to FIGS. 7, 8 and 9, the present first preferred embodiment of my shade operator has a generally cylindrical hub 18 with central cavity 17. Spool 11 is attached at one end of hub 18. The hub is sized so that the roller 2 of the roller shade or take-up spool or tube 31 of the pleated or cellular shade will snugly fit over the hub 18. Thus, when hub 18 turns the roller 2 or tube 31 will also turn. Coil spring 42 has two tangs 45 and 47 that are turned inwardly toward a center line through the spring. Spring 42 fits over core 44 so that tang 45 is retained in hole 46A and tang 47 is retained in slot 46. This assembly then fits within cavity 17 of hub 18. Spring 42 is sized so that in a relaxed state the spring will press lightly against the inner surface of cavity 17. When blade 50 is held in a bracket, core 44 is restrained from movement. Thus, when the hub 18 rotates in one direction, the friction with the spring will tend to expand the spring diameter which will press against the interior surface of hub 18 increasing the friction until the hub can no longer turn under normal operating loads since the spring is held fast by tang 47. That tang 47 is contained in hole 46A in core 44. The core 44 is restrained by the blade 50 that is held in a bracket which is fastened to the wall or window frame. Consequently, hub 18 and attached roller or spool will not move. When the hub 18 is turned in the other direction, the friction tends to reduce the spring diameter which in turn reduces the diameter of the spring allowing the hub and attached roller or spool to rotate. A bore 43 is provided for receipt of stub shaft 49. Tang 47 is fitted through slot 46 and into hole 48 provided in stub shaft 49. Linkage 14 is attached to shaft 49. When assembled the linkage will be positioned as shown in FIG. 8 at a resting position between surfaces 53 and 54. Those surfaces act as stops limiting the movement of the linkage. A force acting on the distal end 55 of the linkage will cause the linkage to move through an arc to a position shown in FIG. 9. Movement of linkage 14 turns shaft 49 moving inserted tang 47. This acts to reduce the diameter of spring 42 so that the spring no longer presses against the inner surface of the cavity 17. Consequently, hub 18 and the attached roller or spool are free to rotate in either direction. Generally this action allows gravity to pull the shade down. The weight of the shade is normally opposed by the spring expanding and binding the hub. This is automatic unless the action is disabled by the operator via the linkage. If the counterbalance spring is then in tension, the spring will retract causing the roll to move until the spring reaches its rest position. This is particularly useful in roller shades where the force of gravity is very small when the shade is all the way up.

Figure 10:
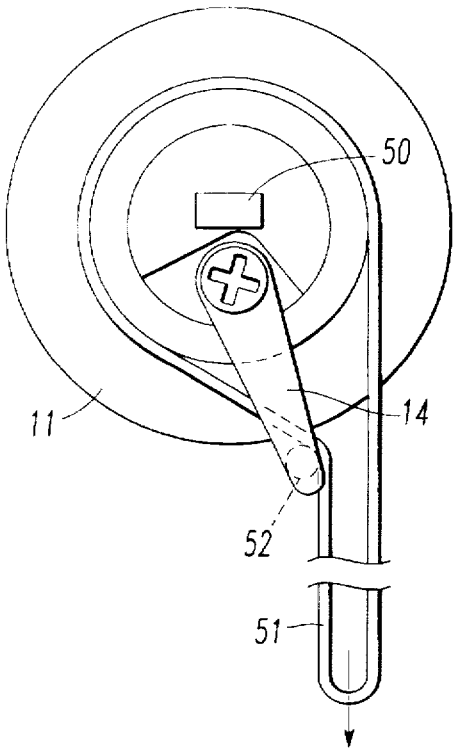
FIG. 10 is an end view of the present preferred shade operator having a loop cord attached thereto with the linkage in a locked position.
Figure 11:
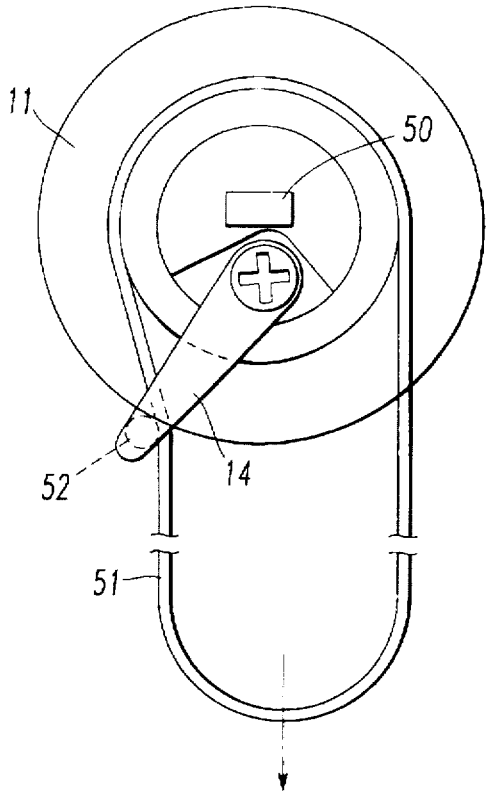
FIG. 11 is an end view similar to FIG. 10 with the linkage is a release position.

Spool 11 may be sized to receive one cord, ribbon or tape which is wound about the spool. In that embodiment a release cord 12 would be attached to the distal end 55 of linkage 14. In an alternative arrangement shown in FIGS. 10 and 11 a cord or bead chain loop 51 is provided. This loop encircles spool 11 (which would have teeth or some other means to engage the loop) and is draped over a saddle 52 which extends transversely from linkage 14. Pulling on the rear half of the loop causes the linkage 14 to move backward contracting the spring 42 which allows free movement of the spool and the roller attached to hub 18.

Figure 12:
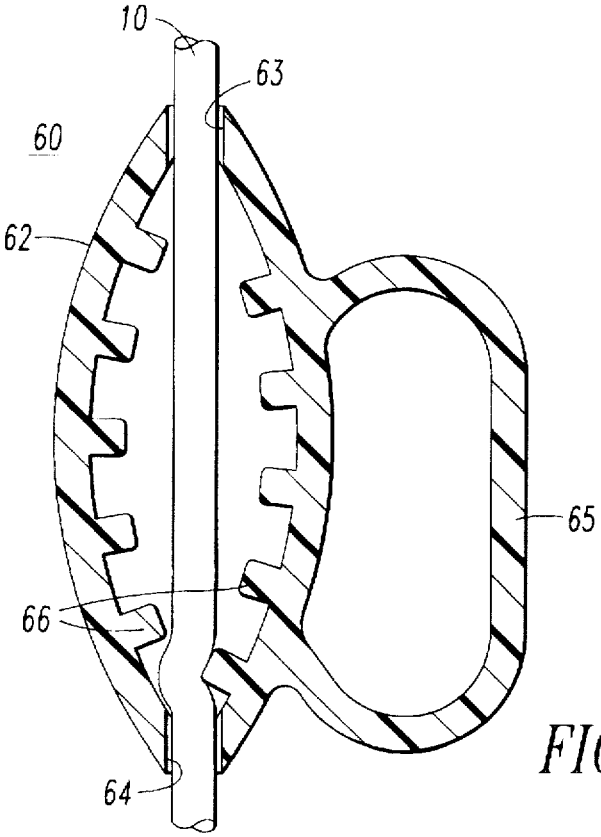
FIG. 12 is a sectional view showing a present preferred cord gripping device on the operating cord.

When a single spool cord is used I prefer to provide a gripping device 60 shown in FIG. 12. This gripping device has a generally oval main body 62. Holes 63 and 64 are provided at opposite ends of the body to allow passage of spool cord 10. Teeth 66 are provided on the interior surface of the body 62. When the body is squeezed together the teeth will engage and grip cord 10 allowing the cord to be easily pulled by the operator. For convenience I prefer to provide a finger loop 65 on the main body. Body 62 is made of a flexible, resilient material such that when squeezing pressure is released the body will return to its original position shown in FIG. 12 allowing the gripping device to be easily slid along the cord. This gripping device is particularly useful for very thin cords. Thin cords allow longer lengths to be wound in a smaller space which means smaller edge clearance is possible.

Figure 13:
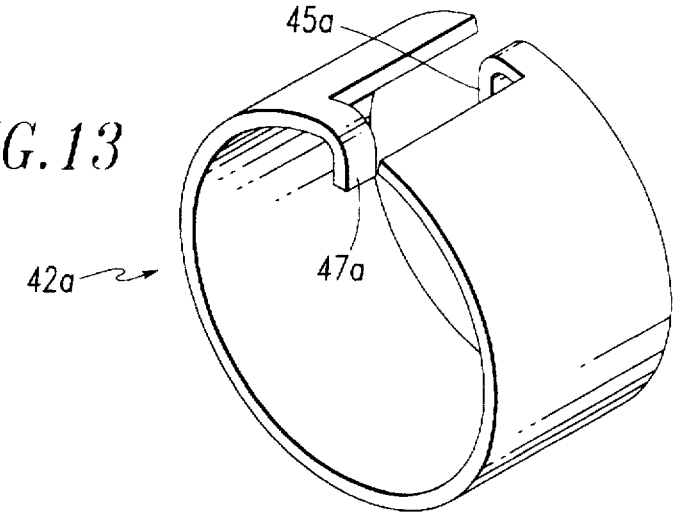
FIG. 13 is a perspective view of a second present preferred spring that can be used in the embodiment of FIGS. 1 thru 12.

Although the spring shown in FIG. 7 has multiple coils, it should be understood that one could use a wider spring band. Such a wider spring 42*a* is shown in FIG. 13. This spring can be substituted for spring 42 in the embodiment of FIG. 7. As with spring 42 tang 47*a* fits in hole 48 on shaft 49 and tang 45*a* fits in hole 46 of core 44.

Figure 14:
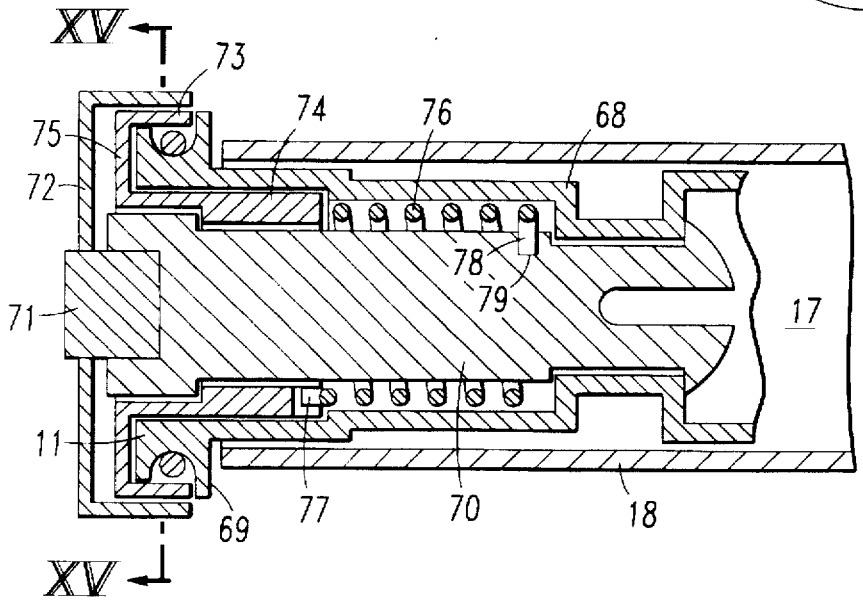
FIG. 14 is a side view of a second present preferred shade operator partially in section.
Figure 15:
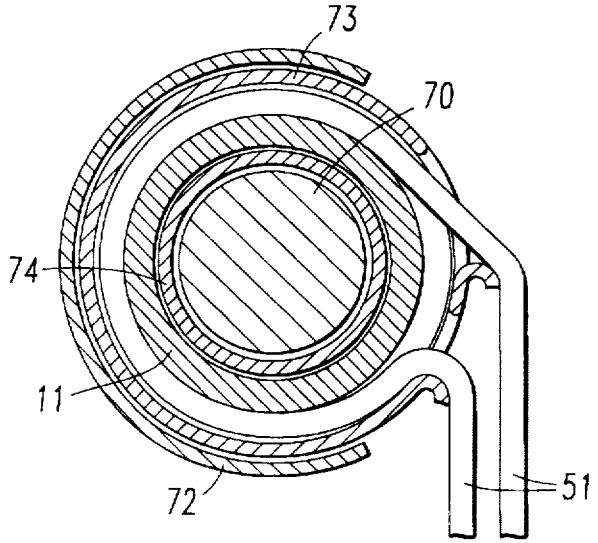
FIG. 15 is a sectional view taken along the line XV—XV of FIG. 14.

In a second present preferred embodiment shown in FIGS. 14 and 15, I provide a sleeve 74 which fits between the core 70 and the hub 68 within cavity 67. As in the previous embodiment, the core has a blade 71 which extends through and is held in a bracket 72. Consequently, core 70 remains stationary. The bracket may have a flange 73 with a window that the spool cord or ribbon passes through. The sleeve 74 also has a flange 75 which extends upward between the bracket 72 and the spool 69 and wraps around the cord opening of the spool. The sleeve 74 is contained longitudinally between stops on the core 70 and the hub 68. Sufficient space is provided between the sleeve flange 75 and the spool 69 so that the hub and attached pulley may turn relative to the sleeve 74 and core 70 when not restrained by spring 76. Spring 76 has a first tang 77 that is attached to the sleeve and a second tang 78 that fits into stationary core 70. As can be seen from FIG. 15 when one pulls either end of the loop cord 51 that will cause the sleeve 74 to rotate downward as indicated by the arrow in FIG. 15. The loop cord normally fills the space between the spool and the sleeve. However, in the drawings the cord is shown smaller for better clarity. Since one tang 77 of spring 76 is affixed to that sleeve rotation of the sleeve will cause the spring to tighten to a smaller diameter. As a consequence, the spring will no longer rest against the inner surface of cavity 67 allowing the hub 68 and roller 90 to freely turn. The sleeve is oriented so that a downward force on either side of loop 51 will cause the sleeve to turn contracting the spring 76 and releasing hub 68.

Figure 16:
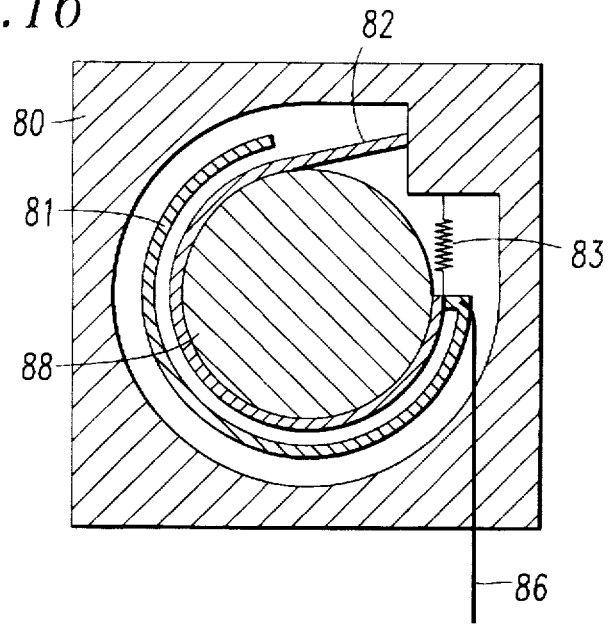
FIG. 16 is an end view of a third present preferred shade operator in a gripping position.
Figure 17:
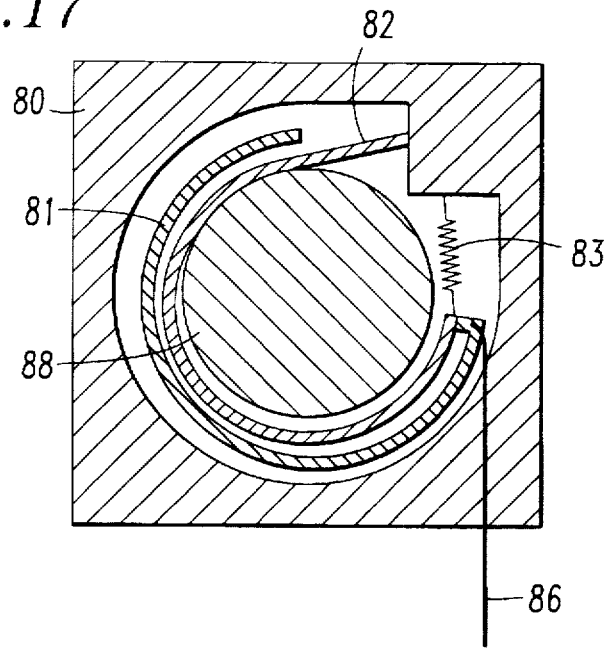
FIG. 17 is an end view of the shade operator of FIG. 16 is a release position.

In a third embodiment shown in FIGS. 16 and 17 a central hub 88 is provided which carriers the roller or means for collecting cords to lift a shade. Housing 80 has a point to which one end of a resilient member 82 is attached. The resilient member may be a strip of spring steel or plastic, or a leather strap. This member encircles hub 88 and is connected at its other end to a sleeve 81 which in turn is connected to a release cord 86. If a leather strap is used, a tension spring 83 is provided to lightly bias the leather strap against the hub 88. The combination of the leather strap 82 and spring 83 function in the same manner as a resilient metal or plastic strap. Release cord 86 is attached to one end of the strap directly or via a sleeve 82 which partially encloses the strap. When the lift cord is pulled and the hub is turned opposite the direction of the arrows, the strap is loosened because the friction pushes the strap towards the end fixed to the housing allowing the hub 88 to rotate freely relative to the housing 80. When the load tries to turn the hub in the direction of the arrow the strap tightens around the hub and prevents it from turning further. The sleeve rotating opposite this arrow will put slack on the strap so that the hub can turn freely in either direction. The sleeve may be turned by a cord loop as in some of the embodiments already described or by a release cord connected to the sleeve and or the strap end that is not fixed to the housing.

Figure 18:
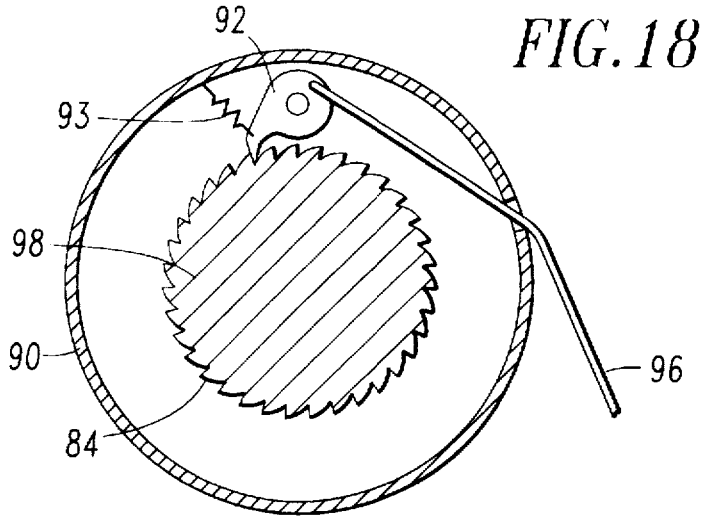
FIG. 18 is an end view of a fourth present preferred shade operator in a gripping position.
Figure 19:
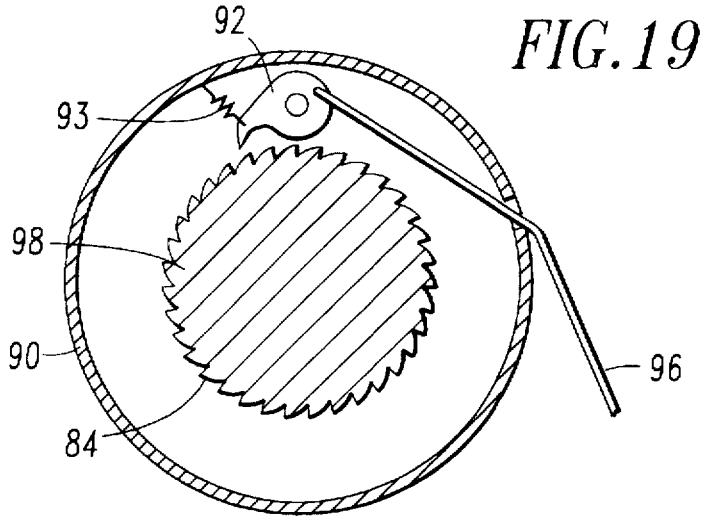
FIG. 19 is an end view of the shade operator of FIG. 18 is a release position.

A fourth embodiment shown in FIGS. 18 and 19 utilizes a pawl and ratchet arrangement. In this device, teeth 84 are provided about the exterior of hub 98 to which the shade roller is attached. Hub 98 fits through an opening in the stationary housing 90. A pawl 92 is carried on stationary housing which is spring biased by spring 93 to press the pawl against teeth 94 on the hub 98. A release cord 96 is attached to the pawl 92. When an operator pulls the release cord 96 the pawl is disengaged from hub 88 allowing it to turn.

Although I have shown and described certain present preferred embodiments of my shade operator, it should be distinctly understood that my invention is not limited thereto but may be variously embodied within the scope of the following claims.

I claim:

1. An operator for a window covering of the type having a roller about which one of a window covering material and lift cords are wound comprising:

a. a stationary member;

b. a moveable member which is moveable relative to the stationary member when not restrained:

c. a spring having a selected diameter, a first tang at one end and a second tang at an opposite end the first tang attached to the stationary member and the second tang attached to the moveable member;

d. a hub having a cavity which has an inside surface and in which the spring is positioned the spring and cavity being sized so that the spring will press against the inside surface of the cavity when in a relaxed condition and the tangs of the spring can be moved relative to one another to reduce the diameter of the spring so that the spring does not restrain movement of the hub, and the hub sized and shaped for attachment of the roller; and e. a spool attached to the hub.

2. The operator of claim 1 also comprising a tang attached to the stationary member for engagement with a mounting bracket.

3. The operator of claim 1 also containing a lift cord connected to the spool.

4. The operator of claim 3 wherein the lift cord is a looped cord.

5. The operator of claim 1 also comprising lift cord attached to the spool in a manner to be wound and unwound around the spool.

6. An improved roller shade of the type having a roller about which window covering material is rolled and unrolled wherein the improvement comprises a shade operator comprised of:

a. a stationary member;

b. a moveable member which is moveable relative to the stationary member when not restrained:

c. a spring having a selected diameter, a first tang at one end and a second tang at an opposite end the first tang attached to the stationary member and the second tang attached to the moveable member;

d. a hub attached to the roller and having a cavity which has an inside surface and in which the spring is positioned the spring and cavity being sized so that the spring will press against the inside surface of the cavity when in a relaxed condition and the tangs of the spring can be moved relative to one another to reduce the diameter of the spring so that the spring does not restrain movement of the hub; and e. a spool attached to the hub.

7. The improved roller shade of claim 6 also comprising a counterbalance spring attached to the roller.

8. The operator of claim 6 also comprising a tang attached to the stationary member for engagement with a mounting bracket.

9. The operator of claim 6 also containing a lift cord connected to the spool.

10. The operator of claim 6 wherein the lift cord is a looped cord.

11. The operator of claim 6 also comprising lift cord attached to the spool in a manner to be wound and unwound around the spool.

12. An improved blind of the type having a roller about which lift cords are rolled and unrolled wherein the improvement comprises a shade operator comprised of:

a. a stationary member;

b. a moveable member which is moveable relative to the stationary member when not restrained:

c. a spring having a selected diameter, a first tang at one end and a second tang at an opposite end the first tang attached to the stationary member and the second tang attached to the moveable member;

d. a hub attached to the roller and having a cavity which has an inside surface and in which the spring is positioned the spring and cavity being sized so that the spring will press against the inside surface of the cavity when in a relaxed condition and the tangs of the spring can be moved relative to one another to reduce the diameter of the spring so that the spring does not restrain movement of the hub; and e. a spool attached to the hub.

13. The improved blind of claim 12 also comprising a tang attached to the stationary member for engagement with a mounting bracket.

14. The improved blind of claim 13 also containing a lift cord connected to the spool.

15. The improved blind of claim 14 wherein the lift cord is a looped cord.

16. The improved blind of claim 12 also comprising lift cord attached to the spool in a manner to be wound and unwound around the spool.

17. An operator for a window covering of the type having a roller about which one of a window covering material and lift cords are wound comprised of:

a. a hub sized so that a first end will fit into one end of the roller and having an interior cylindrical cavity open at a second end of the hub opposite the first end;

b. a coil spring having an inner tang at one end and an outer tang at an opposite end both tangs extending toward a centerline through the coil spring, the coil spring positioned within the interior cylindrical cavity of the hub;

c. a core positioned within the coil spring, the core having an exterior slot into which the inner tang of the coil spring extends and an eccentric bore open at an outer end of the core;

d. a stub shaft partially inserted into the eccentric bore and having a transverse slot into which the outer tang of the coil spring is fitted;

e. a lever attached to an outer end of the stub shaft;

f. a stop attached to the outer end of the core and being sized and positioned to limit movement of the lever through an arc so that when the lever is at one end of the arc the coil spring will engage an inner surface of the interior cylindrical cavity restraining movement of the hub and when the lever is at an opposite end of the arc the coil spring will not restrain movement of the hub; and g. a shade mounting bracket tang extending from a center of the outer end of the core.

18. The operator of claim 17 also comprising a spool attached to the hub adjacent to the second end of the hub.

19. The roller shade operator of claim 18 also comprising lift cord attached to the spool in a manner to be wound and unwound around the spool.

20. The operator of claim 18 also comprising a pulley attached to the lever and wherein the lift cord passes over the pulley.

21. The operator of claim 17 also comprising a release cord attached to the lever for moving the lever through the arc.

22. The operator of claim 21 also comprising a ball attached to a distal end of the release cord and having a passageway through which the lift cord passes.

23. The operator of claim 17 also comprising a release wand attached to the lever for moving the lever through the arc.

24. The operator of claim 17 also comprising a lift cord attached to the hub in a manner to be wound and unwound about the hub.

25. The operator of claim 24 also comprising a lift cord gripping device through which the lift cord passes, the lift cord gripping device comprised of:

a. a flexible oval body having opposite inside surfaces and a hole at each opposite end through which the lift cord may freely pass when the inside surfaces are spaced apart; and b. a plurality of resilient teeth attached to each of the opposite inside surfaces at least some of the teeth engaging a lift cord passing through the body when the oval body is squeezed to cause the opposite inside surfaces to move toward one another.

26. The operator of claim 25 wherein the resilient teeth are sized and positioned so that at least some of the teeth will mate and releaseably lock when the opposite inside surface are moved a given distance toward one another.

27. An operator for a window covering of the type having at least one roller about which one of a window covering material and lift cords are wound comprising:

a. a stationary member having a bore passing through the stationary member;

b. a movable member which is movable relative to the stationary member when not restrained, the movable member having a bore passing through the movable member which bore is aligned with the bore passing through the stationary member;

c. a hub rotatably disposed through the bore in the movable member and the bore in the stationary member, the hub having one end connected to the roller and an outside surface; and d. an elongated resilient member having opposite ends, the resilient member encircling and lightly pressing against the outside surface of the hub, the resilient member attached at one end to the stationary member such that when the hub turns in one direction the resilient member is loosened and when the hub turns in an opposite direction the resilient member tightens around the hub and prevents the hub from turning.

28. The operator of claim 27 wherein the resilient member is comprised of a strip of material selected from the group consisting of spring steel, plastic and leather.

29. The operator of claim 28 wherein the resilient member is also comprised of a coil spring attached between the strip of material and the stationary member.

* * * * *